US007874702B2

(12) United States Patent
Shuai et al.

(10) Patent No.: US 7,874,702 B2
(45) Date of Patent: Jan. 25, 2011

(54) LED LAMP WITH IMPROVED HEAT DISSIPATING STRUCTURE

(75) Inventors: Chun-Jiang Shuai, Shenzhen (CN); Guang Yu, Shenzhen (CN)

(73) Assignees: Fu Zhun Precision Industry (Shen Zhen) Co., Ltd., Shenzhen, Guangdong Province (CN); Foxconn Technology Co., Ltd., Tucheng, Taipei County (TW)

( * ) Notice: Subject to any disclaimer, the term of this patent is extended or adjusted under 35 U.S.C. 154(b) by 6 days.

(21) Appl. No.: 12/396,476

(22) Filed: Mar. 3, 2009

(65) Prior Publication Data

US 2009/0323348 A1 Dec. 31, 2009

(30) Foreign Application Priority Data

Jun. 27, 2008 (CN) ..... 2008 1 0068072

(51) Int. Cl.
*F21V 29/00* (2006.01)

(52) U.S. Cl. ..... 362/294; 362/218; 362/373

(58) Field of Classification Search ..... 362/264, 362/294, 373, 218, 547
See application file for complete search history.

(56) References Cited

U.S. PATENT DOCUMENTS 5,806,965 A * 9/1998 Deese ..... 362/249.04
6,955,451 B2 * 10/2005 Coushaine et al. ..... 362/294
7,014,337 B2 * 3/2006 Chen ..... 362/240
7,703,949 B2 * 4/2010 Lai ..... 362/294
2005/0110649 A1 * 5/2005 Fredericks et al. ..... 340/815.45
2005/0174780 A1 * 8/2005 Park ..... 362/294
2007/0230172 A1 * 10/2007 Wang ..... 362/249
2008/0013316 A1 * 1/2008 Chiang ..... 362/264

* cited by examiner

*Primary Examiner*—Y My Quach Lee
(74) *Attorney, Agent, or Firm*—Frank R. Niranjan

(57) ABSTRACT

An LED lamp includes a first heat sink, a heat-absorbing member receiving the first heat sink therein, a plurality of LED modules attached to the heat-absorbing member, a second heat sink disposed on the first heat sink and the heat-absorbing member, and a lens coupled to the first and second heat sinks and enclosing the heat-absorbing member and the LED modules therein. The first heat sink has a conducting cylinder which defines a first through hole therein. The heat-absorbing member consists of a plurality of vapor chambers and has inclined outer faces oriented downwardly, on which the LED modules are mounted. The second heat sink includes an annular base which defines a second through hole in a center thereof. The second through hole communicates with the first through hole of the first heat sink.

17 Claims, 5 Drawing Sheets

LED LAMP WITH IMPROVED HEAT DISSIPATING STRUCTURE

BACKGROUND OF THE INVENTION

1. Field of the Invention

The present disclosure relates to LED (light emitting diode) lamps and, more particularly, to an LED lamp incorporating a heat dissipating structure.

2. Description of Related Art

As an energy-efficient light, an LED lamp has a trend of substituting for the fluorescent lamp for indoor lighting purpose; in order to increase the overall lighting brightness, a plurality of LEDs are often incorporated into a signal lamp, in which how to efficiently dissipate heat generated by the plurality of LEDs becomes a challenge.

A typical LED lamp for illumination comprises a planar metal board functioning as a heat sink and a plurality of LEDs mounted on a common side of the board. The LEDs are arranged in a matrix that comprises a plurality of mutually crossed rows and lines. When the LEDs are activated to lighten, heat generated by the LEDs is dispersed to ambient air via the board by natural air convection.

However, in order to achieve a higher lighting intensity, the LEDs are arranged into a number of crowded groups, whereby the heat generated by the LEDs is concentrated at discrete spots, which leads to an uneven heat distribution over the board. The conventional board is not able to dissipate the locally-concentrated and unevenly-distributed heat timely and efficiently, whereby a heat accumulation occurs in the board easily. Such a heat accumulation may cause the LEDs to overheat and to have an unstable operation or even a malfunction.

What is needed, therefore, is an LED lamp which can overcome the above-mentioned disadvantages.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
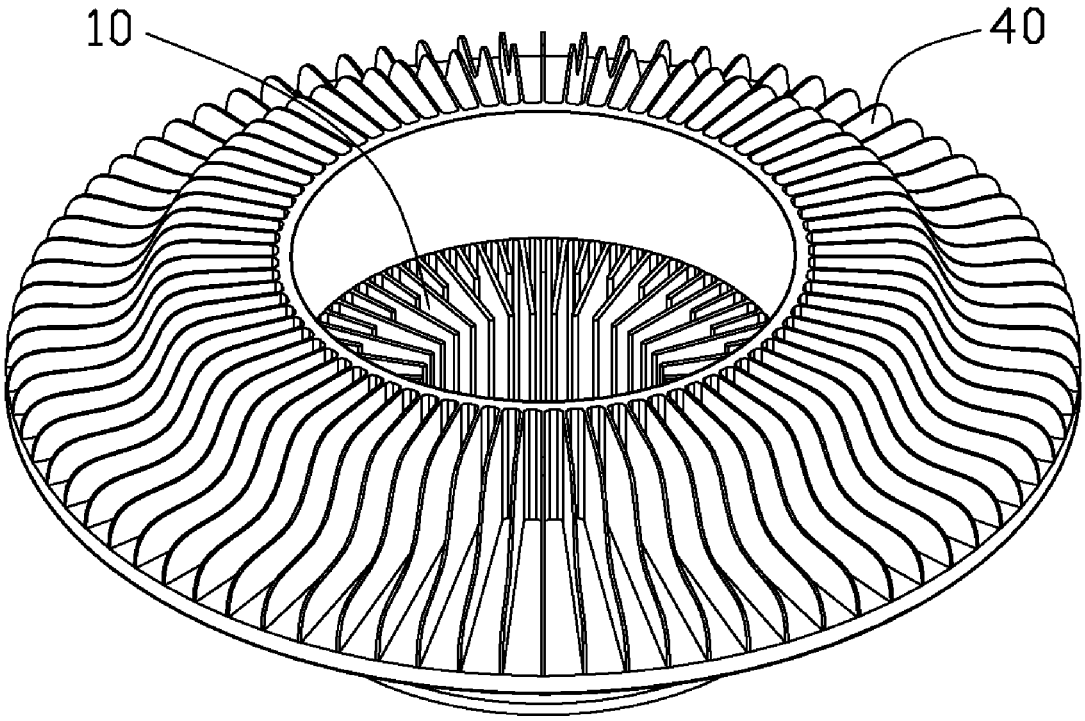
FIG. 1 is an assembled, isometric view of an LED lamp in accordance with an embodiment of the disclosure.
Figure 2:
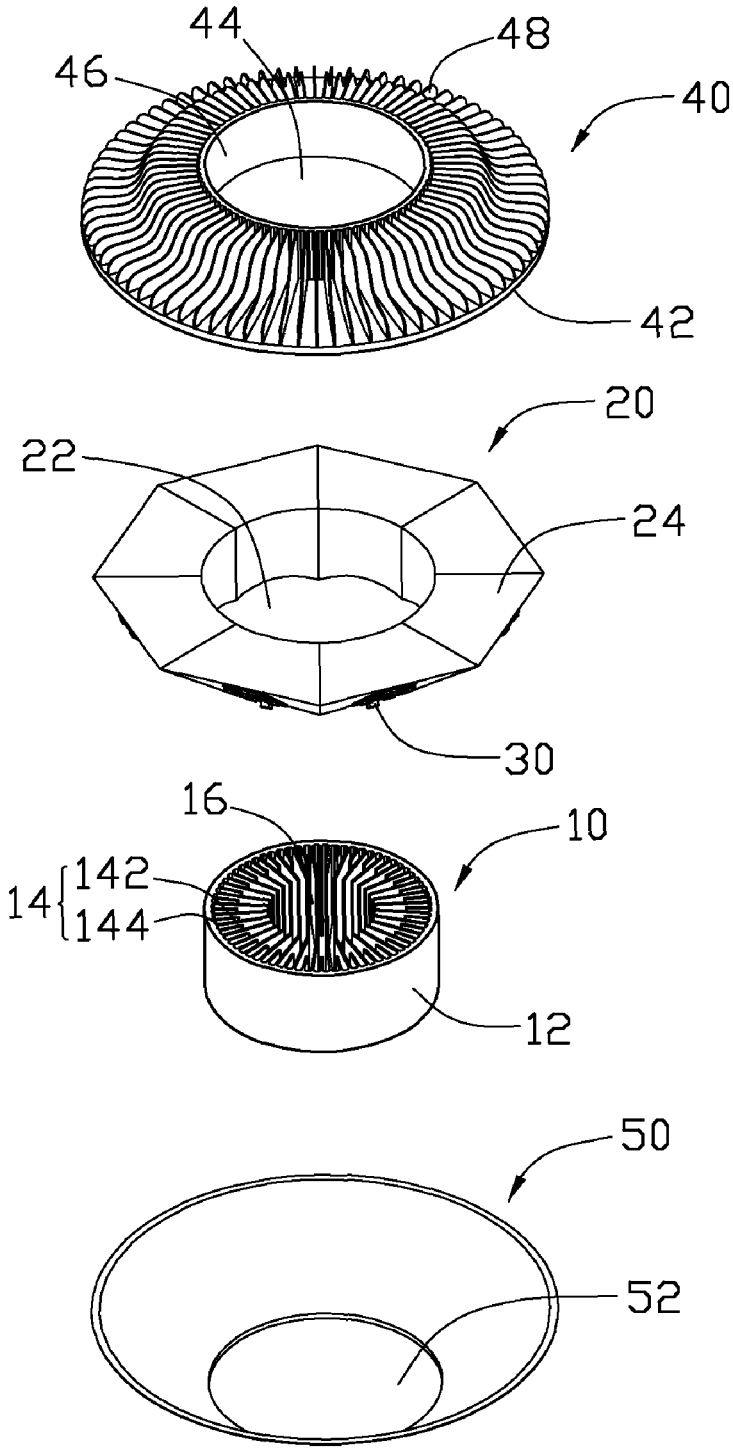
FIG. 2 is an exploded view of the LED lamp of FIG. 1.

Referring to FIGS. 1-2, an LED lamp in accordance with an embodiment of the disclosure is used in such occasions that need high lighting intensity, such as street, gymnasium, sport court and so on. The LED lamp comprises a first heat sink 10, a heat-absorbing member 20 encompassing and attached to a circumference of the first heat sink 10, a plurality of LED modules 30 attached to the heat-absorbing member 20, a second heat sink 40 disposed on the first heat sink 10 and the heat-absorbing member 20, and a lens 50 coupled to the first and second heat sinks 10, 40 and enclosing the heat-absorbing member 20 and the LED modules 30 therein.

The first heat sink 10 is integrally made of a metal with good heat conductivity, such as aluminum, copper, or an alloy thereof. The heat sink 10 comprises a conducting cylinder 12 which defines a first through hole 16 therein and a plurality of inner fins 14 extending inwardly and racially from an inner circumferential surface of the conducting cylinder 12. The inner fins 14 comprise a plurality of first fins 142 and second fins 144. Each of the first fins 142 has a length longer than that of each of the second fins 144. The first fins 142 and the second fins 144 are alternate and spaced apart evenly with each other.

Figure 3:
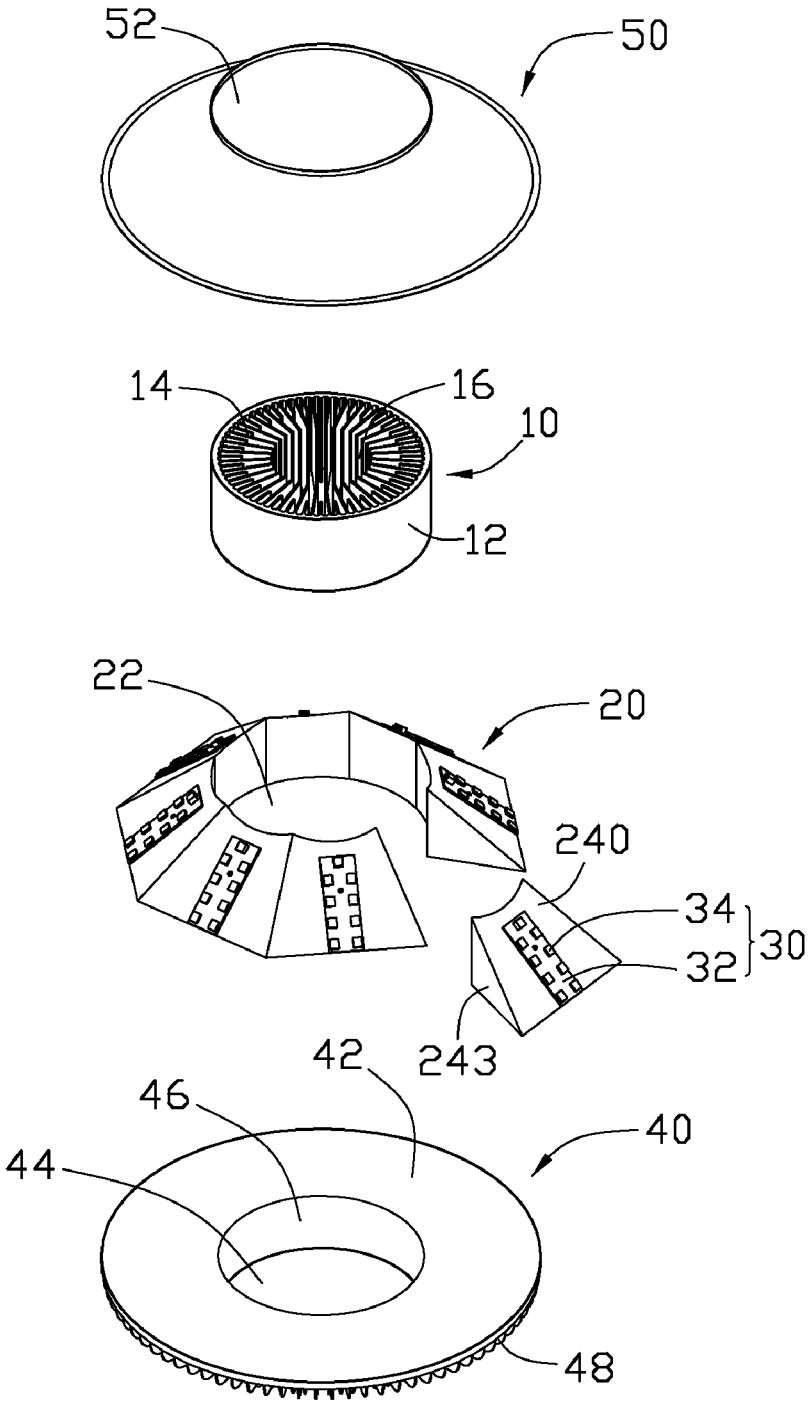
FIG. 3 is an inverted, exploded view of the LED lamp of FIG. 1.
Figure 4:
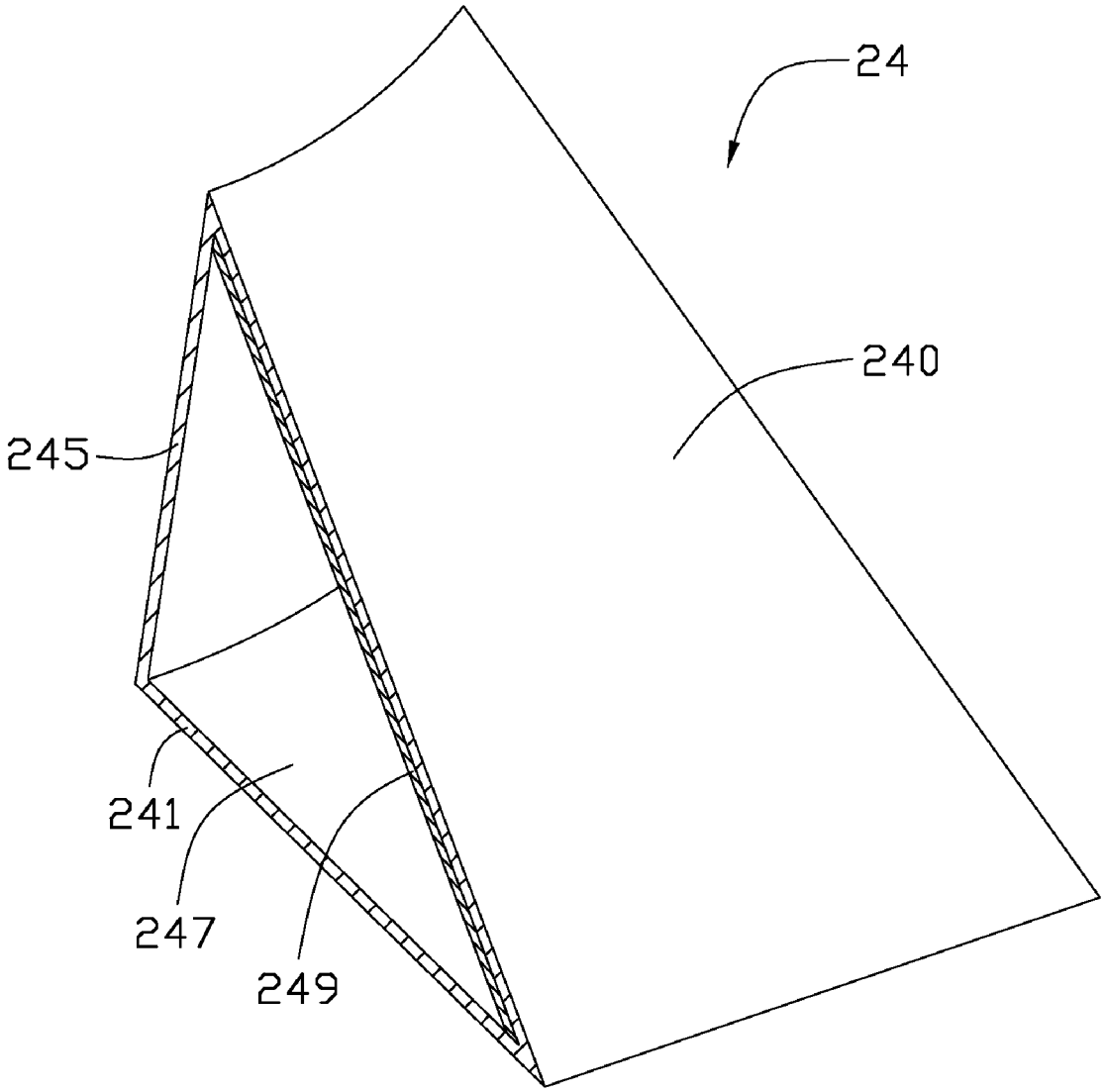
FIG. 4 shows a heat-absorbing portion of the LED lamp of FIG. 3, with a part of the heat-absorbing portion being removed for clarity.
Figure 5:
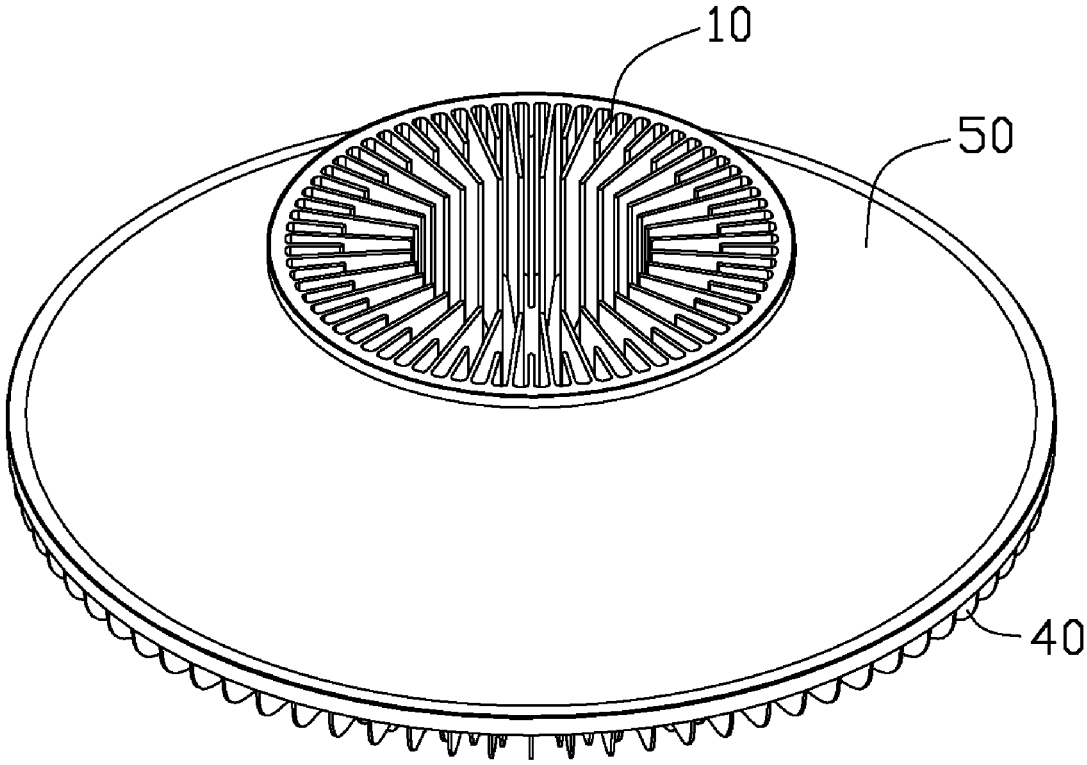
FIG. 5 is an inverted view of the LED lamp of FIG. 1.

Referring to FIGS. 3 and 4 also, the heat-absorbing member 20 is made of a metal with good heat conductivity, such as aluminum, copper or an alloy thereof. The heat-absorbing member 20 has a configuration like an inverted frustum and defines a receiving hole 22 in a central portion thereof. The receiving hole 22 has an inner diameter identical to an outer diameter of the conducting cylinder 12 of the first heat sink 10 for snugly receiving the first heat sink 10 therein. The heat-absorbing member 20 consists of eight heat-absorbing portions 24, each of which is hollow in structure. The eight heat-absorbing portions 24 are identical to each other and centrosymmetrical relative to a central axis of the heat-absorbing member 20. Each of the heat-absorbing portions 24 has two opposite right-angled-triangular side faces 243 spacing from each other and thermally contacting corresponding side faces 243 of adjacent heat-absorbing portions 24. The two side faces 243 have two vertical sides adjacent to the receiving hole 22, which are substantially parallel to each other, and two top sides gradually remote from each other along a direction away from the receiving hole 22. A top flat face 241 interconnects the two top sides of the two side faces 243 for contacting the second heat sink 40. A curved face 245 interconnects the two vertical sides of the two side faces 243 and thermally contacts the outer circumferential surface of the conducting cylinder 12 of the first heat sink 10. An inclined outer face 240 interconnects two hypotenuses of the two side faces 243 and is oriented downwardly. The LED module 30 is mounted on the inclined outer face 240. The outer face 240, the top face 241, the side faces 243 and the curved face 245 cooperatively define a hermetical chamber 247 containing working fluid therein. A wick structure 249 is formed on an inner face of the heat-absorbing portion 24 opposite the outer face 240. Thus, each heat-absorbing portion 24 has a structure of a vapor chamber. In order to enhance a heat transferring capability between the heat-absorbing member 20 and the first heat sink 10, thermal grease is preferably used to fill gaps existed therebetween.

Eight LED modules 30 are thermally mounted on the outer faces 240 of the heat-absorbing portions 24 of the heat-absorbing member 20, respectively. Each of the LED modules 30 comprises an elongated printed circuit board 32 and a plurality of LEDs 34 evenly mounted on a side of the printed circuit board 32. The LEDs 34 of each of the LED modules 30 are arranged along a length of the printed circuit board 32. Each of the eight LED modules 30 is thermally mounted on the inclined outer face 240 of each of the eight heat-absorbing portions 24.

The second heat sink 40 is integrally made of a metal with good heat conductivity, such as aluminum, copper, or an alloy thereof. The second heat sink 40 comprises an annular base 42 which defines a second through hole 44 in a central portion thereof, a tube 46 extending upwardly and perpendicularly from a top surface of the base 42 and correspondingly surrounding the second through hole 44 and a plurality of outer fins 48 extending upwardly from the top surface of the base 42 and located radially relative to an outer circumferential surface of the tube 46. The base 42 is correspondingly disposed on the top faces of heat-absorbing portions 24 of the heat-absorbing member 20. The second through hole 44 of the base 42 directly and coaxially communicates with the first through hole 16 of the first heat sink 10.

Referring to FIG. 4 also, the lens 50 is made of transparent material, such as glass, plastic, or other suitable materials availing to transmit light. The lens 50 has a bowl-shaped configuration and defines a concave through hole 52 at a central portion thereof. A lower end of the lens 50 correspondingly surrounds a periphery of a bottom end of the conducting cylinder 12. An upper end of the lens 50 is coupled to an outmost circumference of a bottom surface of the base 42 of the second sink 40.

Referring to FIGS. 1-4 again, in use, according to the exemplary embodiment of the disclosure, when the LEDs 34 of the LED modules 30 emit light, heat generated by the LEDs 34 is absorbed by the heat-absorbing member 20 and then transferred to the first heat sink 10 and the second heat sink 40. Finally, the heat is dispersed into ambient air via the inner fins 14 and the outer fins 48. Furthermore, the first and second through holes 16, 44 located at a central portion of the LED lamp communicates with each other and the ambient air, whereby helping natural air convection through the first and second heat sinks 10, 40. Thus, the LED lamp in accordance with the illustrated embodiment of the disclosure has an improved heat dissipating efficiency for preventing the LEDs 34 from overheating. In addition, the heat-absorbing portions 24 of the heat-absorbing member 20 respectively have the inclined outer faces 240 on which the LED modules 30 are mounted and the heat-absorbing portions 24 are radially located around the conducting cylinder 12 of the first heat sink 10. Accordingly, light emitted by the LED modules 30 is distributed over a large region.

It is believed that the present embodiments and their advantages will be understood from the foregoing description, and it will be apparent that various changes may be made thereto without departing from the spirit and scope of the invention or sacrificing all of its material advantages, the examples hereinbefore described merely being exemplary or exemplary embodiments of the invention.

What is claimed is:

1. An LED lamp comprising:

a first heat sink having a conducting cylinder defining a first through hole therein;

a heat-absorbing member defining a receiving hole in a center thereof for receiving the first heat sink therein, the heat-absorbing member having inclined outer faces oriented downwardly;

a plurality of LED modules mounted on the inclined outer faces of the heat-absorbing member; and a second heat sink disposed on a top face of the heat-absorbing member, the second heat sink comprising an annular base which defines a second through hole in a center thereof, the first and second through holes communicating with each other and ambient air.

2. The LED lamp as claimed in claim 1, wherein the heat-absorbing member comprises a plurality of heat-absorbing portions connecting with each other along a circumferential direction of the heat-absorbing member.

3. The LED lamp as claimed in claim 2, wherein the heat-absorbing portions are identical to each other and centrosymmetrical relative to a central axis of the heat-absorbing member.

4. The LED lamp as claimed in claim 2, wherein each of the heat-absorbing portions has an inclined outer face oriented downwardly, on which a corresponding one of the LED modules is mounted, a flat face extending inwardly from a top edge of the inclined outer face of the each of the heat-absorbing portions and thermally contacting the base of the second heat sink, and a curved face extending downwardly from an inner edge of the flat face and thermally contacting the conducting cylinder of the first heat sink.

5. The LED lamp as claimed in claim 2, wherein each of the heat-absorbing portions defines a hermetical chamber containing a wick structure and working fluid therein.

6. The LED lamp as claimed in claim 1, wherein the receiving hole of the heat-absorbing member snugly receives the conducting cylinder of the first heat sink therein.

7. The LED lamp as claimed in claim 1, wherein a plurality of inner fins extends inwardly from an inner circumferential surface of the conducting cylinder.

8. The LED lamp as claimed in claim 1, wherein a tube extends upwardly from a top surface of the base and correspondingly surrounds the second through hole.

9. The LED lamp as claimed in claim 7, wherein a plurality of outer fins extends upwardly from the top surface of the base and located around an outer circumferential surface of the tube, and wherein heat generated by the LED modules is dispersed into the ambient air via the inner fins and the outer fins.

10. The LED lamp as claimed in claim 1, wherein the second through hole of the base is coaxial with the first through hole of the conducting cylinder.

11. The LED lamp as claimed in claim 1 further comprising a lens coupled to the first and second heat sinks and enclosing the heat-absorbing member and the LED modules therein.

12. The LED lamp as claimed in claim 11, wherein the lens has a bowl-shaped configuration and defines a concave through hole in a central portion thereof, a lower end of the lens correspondingly surrounds a periphery of a bottom end of the conducting cylinder, an upper end of the lens is coupled to a bottom surface of the base.

13. An LED lamp comprising:

a first heat sink comprising a conducting cylinder which defines a first through hole therein and a plurality of inner fins extending inwardly from an inner circumferential surface of the conducting cylinder;

a heat-absorbing member consisting of at least one vapor chamber mounted around the first heat sink and thermally connecting therewith;

a plurality of LED modules mounted on the heat-absorbing member and located around the first heat sink; and a second heat sink disposed on the first heat sink and the heat-absorbing member, the second heat sink comprising an annular base defining a second through hole in a center thereof, a tube extending upwardly from a top surface of the base and surrounding the second through hole, and a plurality of outer fins extending upwardly from the top surface of the base, the first and second through holes communicating with each other and ambient air, heat generated by the LED modules being dispersed into the ambient air via the inner fins and the outer fins.

14. The LED lamp as claimed in claim 13, wherein the heat-absorbing member engages a circumference of the conducting cylinder of the first heat sink.

15. The LED lamp as claimed in claim 14, wherein the heat-absorbing member consists of a plurality of vapor chambers, the vapor chambers are identical to each other and centrosymmetrical relative to a central axis of the heat-absorbing member.

16. The LED lamp as claimed in claim 14, wherein each of the vapor chambers has an inclined outer face oriented downwardly, on which a corresponding one of the LED modules is mounted, a flat face thermally contacting the base of the second heat sink, and a curved face thermally contacting the conducting cylinder of the first heat sink.

17. The LED lamp as claimed in claim 13, further comprising a lens having a bowl-shaped configuration for enclosing the LED modules therein, wherein a lower end of the lens correspondingly surrounds a periphery of a bottom end of the conducting cylinder, and an upper end of the lens is coupled to a bottom surface of the base.

* * * * *